United States Patent [19]

Pawlak et al.

[11] Patent Number: 4,966,608

[45] Date of Patent: Oct. 30, 1990

[54] PROCESS FOR REMOVING PYRITIC SULFUR FROM BITUMINOUS COALS

[75] Inventors: Wanda Pawlak; Jerzy S. Janiak; Ali A. Turak; Boleslaw L. Ignasiak, all of Edmonton, Canada

[73] Assignee: Electric Power Research Institute, Inc., Palo Alto, Calif.

[21] Appl. No.: 230,139

[22] Filed: Aug. 9, 1988

[51] Int. Cl.[5] ..... C10L 9/00

[52] U.S. Cl. ..... 44/624; 44/627; 209/171; 209/173

[58] Field of Search ..... 44/624, 626, 627; 201/17; 209/171, 173

[56] References Cited

U.S. PATENT DOCUMENTS

| | | | |
|---|---|---|---|
| 3,725,538 | 4/1973 | Brewer | 423/449 |
| 3,856,668 | 12/1974 | Shubert | 210/21 |
| 4,021,206 | 5/1977 | Huberts et al. | 44/626 |
| 4,033,729 | 7/1977 | Capes et al. | 44/1 A |
| 4,203,727 | 5/1980 | Simpson | 44/624 |
| 4,234,320 | 11/1980 | Verschaar | 44/23 |
| 4,249,910 | 2/1981 | Masologites et al. | 44/1 SR |
| 4,282,004 | 8/1981 | Masologites | 44/626 |
| 4,297,108 | 10/1981 | Howartz et al. | 44/1 SR |
| 4,309,192 | 1/1982 | Kubo et al. | 44/51 |
| 4,396,396 | 8/1983 | Mainwaring et al. | 44/24 |
| 4,415,335 | 11/1983 | Mainwaring | 44/1 C |
| 4,436,618 | 3/1984 | Rigby et al. | 44/626 |
| 4,448,585 | 5/1984 | Yoo | 44/624 |
| 4,456,528 | 6/1984 | Akamoto et al. | 209/49 |
| 4,496,533 | 1/1985 | Clausius | 423/448 |
| 4,579,650 | 4/1986 | Nankee et al. | 209/11 |
| 4,583,990 | 4/1986 | McGarry et al. | 44/51 |
| 4,601,729 | 7/1986 | Capes et al. | 44/51 |

FOREIGN PATENT DOCUMENTS

| | | |
|---|---|---|
| 1144500 | 4/1983 | Canada . |
| 2023172A | 12/1979 | United Kingdom . |

OTHER PUBLICATIONS

Perrott & Kinney, Chemical and Metallurgical Engineering, 25 (5), 182–188 (1921).

Ademodi, et al., Energy Sources, vol. 9, pp. 173–188 (1987).

*Primary Examiner*—Carl F. Dees

*Attorney, Agent, or Firm*—Flehr, Hohbach, Test, Albritton & Herbert

[57] ABSTRACT

A process is provided for removing pyritic sulfur and lowering ash content of bituminous coals by grinding the feed coal, subjecting it to micro-agglomeration with a bridging liquid containing heavy oil, separating the microagglomerates and separating them to a water wash to remove suspended pyritic sulfur. In one embodiment the coal is subjected to a second micro-agglomeration step.

8 Claims, 1 Drawing Sheet

PROCESS FOR REMOVING PYRITIC SULFUR FROM BITUMINOUS COALS

The present invention is directed to a process for reducing pyritic sulfur and ash content of bituminous coals by grinding and agglomeration.

BACKGROUND OF THE INVENTION

One of the most difficult problems in the preparation of coal is reducing the sulfur content of the coal, which normally can exist in three forms: organic; pyritic; and as sulfate. Since the organic sulfur is distributed through the coal matrix as an integral part of the coal molecular structure, its removal requires chemical treatment. Pyritic sulfur may be removed by physical cleaning processes to various extents. The sulfate sulfur, except for oxidized or weathered coals, is usually less than 0.1% and is not usually an important factor in the clean-up of coal.

Thus, there are two types of desulfurization processes for coal prior to its utilization: chemical processes directed usually to oxidation or reduction of sulfur; and physical processes. The chemical processes include those which are conducted at elevated temperatures using gases such as hydrogen, nitrogen, chlorine, steam, air, etc., or with solutions such as sodium hydroxide, ferric sulfate, cupric sulfate, etc. These chemical methods are capable of removing both the organic and inorganic sulfur, but the degree of desulfurization depends upon the particular method. A disadvantage of chemical processes is that they usually cause decrease in coal volatile matter and in the heating value of the coal. Furthermore, the operating costs of chemical methods can be prohibitively expensive and the processes themselves can, in turn, produce toxic waste products.

It is therefore important to develop advanced physical methods of cleaning coal, such as by improving the conventional froth flotation methods, selective flocculation methods, oil agglomeration methods, magnetic separation methods, etc. One of the drawbacks is that physical cleaning methods usually remove only the part of the pyritic sulfur which can be liberated during coal comminution. The degree of mineral matter (pyrite) removal is dependent upon the mineral matter size, its distribution, the pyrite particle size, and other physical characteristics of the raw coal.

Oil agglomeration, one of the conventional physical cleaning methods, is based on the principle that coal particles are hydrophobic, or at least less hydrophilic, than the inorganic materials in the coal and therefore can be agglomerated and separated from mineral matter by addition of a suitable bridging liquid which wets the carbonaceous (hydrophobic) constituents.

However, studies show that poor pyrite rejection in oil agglomeration of coal is observed. See Gregory, I. W., "Oil Agglomeration of Coal Fines", *Mining Technology Clearinghouse,* R & D Commentary, 1982; Mezey, E. J., "Application of Oil Agglomeration to Coal Wastes", *United States EPA Report.* EPA 600/7-79-025C, 1979. In an attempt to overcome this problem, a number of methods for altering the surface characteristics of pyrite have been investigated, which are based on the alteration of the pyrite surface to render it hydrophilic.

Perrott, et al., *Chemical and Metallurgical Engineering,* 25 (5), 182–188 (1921), disclose the wet grinding of powdered coal, water and oil wherein the oil comprises 30% by weight of coal, and agitation of a slurry of these components to form an amalgam of oil and coal which can be separated from the water, ash and other hydrophilic components. In another process discussed by Perrott, et al. in the same publication, a slurry of powdered coal, water and oil wherein the oil comprises 25% by weight of coal is agitated and the coal/oil amalgam is separated from the hydrophilic components and ash by screening on a 100 mesh screen. By this process the pyritic sulfur reduction in bituminous coal is exemplified as being reduced from 3.01% in a bituminous feed coal to 2.10% in the recovered amalgam. In both of the aforementioned processes, the amount of oil is greater than 10% by weight of the coal and the reported pyritic sulfur reduction is minimal.

Canadian Patent No. 1,144,500 discloses the agitation of a slurry of oil, coal and water containing up to 50% by weight solids to form coal agglomerates. The agglomerates are separated by screening and the volatiles from the agglomerates are extracted by flashing. The agglomerates are merely separated from the hydrophilics and inorganics by screening and there is no disclosure of an agitation-aeration-separation wash cycle as disclosed herein which advantageously removes pyrite.

U.S. Pat. No. 3,856,668 discloses the screening of coal particulates in a water slurry containing about 2–10% hydrocarbon by weight of coal (preferably 3–7% if the hydrocarbon is a heavy oil). There is no disclosure of an agitation-aeration-separation wash cycle which advantageously removes pyrite according to the present invention.

Additional difficulties regarding pyrite rejection during oil agglomeration are the problem of dealing with the different degrees of dissemination of pyrite in the coal matrix, depending on the type and source of the coal; and the presence of other minerals, such as chalcopyrite ($CuFeS_2$) in the pyrite. Usually a high degree of dissemination of the pyrite in the coal makes the pyrite removal more difficult and also the incorporation of chalcopyrite into the pyrite may change the surface properties of the pyrite in terms of its response to oxidation or action of depressing agents. It has therefore been found that successful modification of the oil agglomeration technique for pyrite rejection in a specific coal might be totally unsuitable for a different coal.

It is an object of the present invention to provide a method for causing pyrite rejection from bituminous coals.

It is another object of the present invention to provide a method which substantially reduces the ash content of bituminous coals.

These and other objects of the present invention will be apparent from the following description of the preferred embodiment and the appended claims and from practice of the invention.

SUMMARY OF THE INVENTION

The present invention provides a method for reducing the sulfur and ash content of bituminous coal comprising the steps of grinding the feed coal to a particle size of less than about 600 micrometers to form a fine coal; mixing the fine coal with water and less than 10% by weight (based on dry coal) of a bridging oil to form a coal-water-oil slurry; agitating the slurry to form coal microagglomerates; separating the coal micro-agglomerates from the slurry to obtain recovered coal characterized by substantially reduced sulfur and ash content as compared to the feed coal. For some bituminous coals, the additional steps are required of wet-grinding the micro-agglomerates, mixing them again with less than 10% by weight of bridging oil to form a second slurry, agitating the second slurry to form micro-agglomerates and separating the microagglomerates to recover the coal.

BRIEF DESCRIPTION OF THE DRAWINGS

In the accompanying figures.

DESCRIPTION OF THE PREFERRED EMBODIMENTS

The process according to the present invention is particularly directed to removal of pyrite and lowering the ash content of bituminous coals.

Bituminous coals, as used herein, are coals having the general characteristics of a volatile matter content varying from 12–45%, a Roga Index from 0 to 55 and a calorific value above about 30 MJ/kg.

The bridging oils used in the process of the present invention consist essentially of from about 100–10% of a heavy oil having an API gravity in the range of 10°–20° API or a bitumen having a gravity in the range of 5.5°–12° API; and from about 0–90% of a lighter oil, such as diesel oil, kerosene or naphtha. In general, however, in place of the heavy oil or bitumen, other low-quality oils may be utilized as one component or the other component of the bridging liquid, such as low-quality oils having an API gravity of about 6–20; sulfur content below 5%; total solids (mg/1) in the range of 1–15; viscosity (CST at 40° C.) in the range of 3–500; and being further characterized as marginally distillable and generally having a high heteroatom contaminant content.

To form micro-agglomerates according to the present invention, bridging liquid is added to the coal in amounts of 10% or less based on the weight of the dry coal, preferably less than 3% and most preferably in the range of 0.5–1.0%. To form the micro-agglomerates, the bridging oil, the coal and a sufficient amount of water is added to make a slurry comprising about 25% by weight of solids and the slurry is agitated to form coal micro-agglomerates which then can be separated from the slurry. The micro-agglomerates are subsequently suspended in clean water (5–15% micro-agglomerates by weight) and the suspension is subjected to a series of rapid agitation-aeration-dirty water removal-clean water addition cycles. Three or more cycles of this four-step cycle will usually suffice to result in about 60–90% removal of pyrite. Preferably, the agitation step is about 30 seconds in duration, followed by aeration. The dirty water (containing pyrite and other mineral matter) may be re-used after clean-up, such as, by pressure filtration and recycled, if desired.

Figure 1:
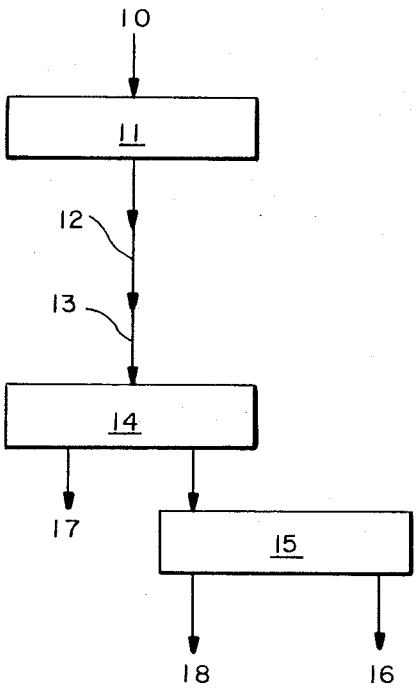
FIG. 1 is a schematic diagram of the steps for single-stage dry-grinding according to the present invention for treatment of bituminous coal.

Referring to FIG. 1. there is disclosed a schematic diagram of the steps for a single-stage agglomeration process according to the present invention for the treatment of bituminous coal.

Referring to FIG. 1, the coal feed 10 is first subjected to dry grinding step 11, such as by ball milling, rod milling, or the equivalent thereof, to form particles of a diameter of about 600 micrometers or less, as determined by standard sieving size. The water 12 and bridging liquid 13 are then added, with the amount of bridging liquid being in the amounts as described above, and sufficient water being present to form a slurry of about 25% by weight of solids. The resulting slurry is then subjected to a microagglomeration step 14 whereby the slurry is agitated to form coal micro-agglomerates. The microagglomerates may then be separated from the slurry by conventional methods (such as, by flotation or screening), suspended in clean water (5–15% macroagglomerates by weight) then washed in step 15 by a series of agitation-aeration-dirty water removal-clean water addition cycles described above, to provide clean coal 16. The tailings 17 from the agglomeration slurry and from the washing step 18 will contain the pyritic sulfur and a substantial number of minerals which comprise ash in the coal.

Figure 2:
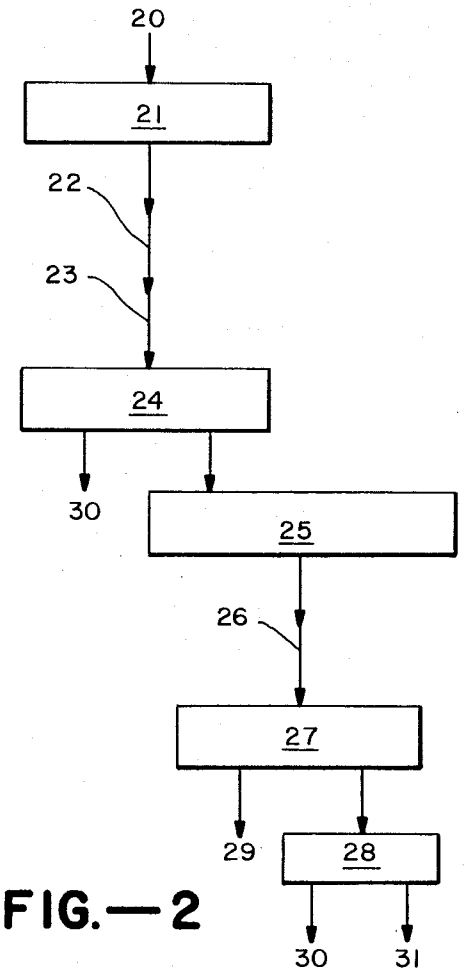
FIG. 2 is a schematic diagram of the steps for two-stage dry and wet-grinding according to the present invention for the treatment of bituminous coals.

Referring to FIG. 2 there is shown an embodiment of the present invention which is also adapted for some bituminous coals. The steps of grinding 21, forming the water-coal slurry by the addition of water 22 and bridging oil 23, and separating the agglomerates and tailings 30 in step 24 are the same as described above in connection with FIG. 1. The additional step 25 of wet grinding, such as by ball milling the initially isolated agglomerates, is shown. Bridging liquid 26 is then added, in the amounts as described above, and reground to form a slurry. The slurry is then again subjected to the agglomeration process 27, which generates micro-agglomerates, which are in turn then subjected to a four-step clean-up cycle 28 described above, which yields a clean micro-agglomerates 31. The tailings 29 and 30 may be cleaned up and re-used, if desired.

The processes according to the present invention are particularly advantageous in that relatively low amounts of bridging liquid are utilized, thus conserving materials and facilitating clean-up of the agglomerates. In general, the processes according to the present invention will also result in reducing the mineral matter (which comprises the ash content) of coal up to about 85%, and reducing the total sulfur content. A total of about 95% of the pyritic sulfur is removed according to the present invention while still recovering about 90% of the combustible material. The foregoing advantages of the present invention are believed to be improvements over those methods of the prior art.

Having described the preferred embodiments of the present invention, the following examples are provided by way of illustration, but not by limitation.

EXAMPLE 1

Four coals of entirely different origin were tested using processing scheme outlined in FIG. 1. Results of these tests are presented in Table 1.

TABLE 1

REMOVAL OF PYRITIC SULFUR FROM COALS USING SINGLE-STAGE PROCESS OF INVENTION

| | Feedstock | | | Product | | | |
|---|---|---|---|---|---|---|---|
| | | % Sulfur | | | | % Sulfur Removal | |
| Coal | % Ash | Total | Pyritic | Wt % Yield | % Ash | Total | Pyritic |
| Montana | 17.8 | 4.4 | 2.8 | 90.0 | 9.5 | 62 | 98 |
| Illinois | 13.6 | 4.2 | 1.3 | 87.6 | 6.8 | 15 | 50 |
| Pennsylvania | 19.2 | 1.13 | 0.58 | 80.0 | 5.9 | 40 | 78 |
| Pittsburgh Seam | 22.0 | 1.7 | 0.95 | 80.9 | 6.0 | 34 | 60 |
| Kentucky No. 9 | 14.6 | 5.1 | 3.10 | 86.6 | 6.8 | 39 | 60 |

EXAMPLE 2

In second series of tests two selected coals (Pittsburgh Seam—see Table 1—and Kentucky No. 9 were subjected to two-stage process of FIG. 2 with interstage wet grinding. Since grinding was carried out in water, the potential for oxidation of pyrite was significantly reduced. If oxidation was critical in pyrite rejection the quantities of pyrite removal in one-or two-stage process should be essentially the same regardless of the degree of liberation (obviously higher as a result of wet grinding). The results presented in Table 2 indicate that 70% of pyrite was rejected from Pittsburgh Seam coal (compared to 60% in Table 1). As expected, the deashing was signficantly better compared to one-stage grinding.

TABLE 2

REMOVAL OF PYRITIC SULFUR FROM COALS USING TWO-STAGE PROCESS OF INVENTION WITH INTERSTAGE WET GRINDING

| | Feedstock | | | Product | | | |
|---|---|---|---|---|---|---|---|
| | | % Sulfur | | | | % Sulfur Removal | |
| Coal | % Ash | Total | Pyritic | Wt % Yield | % Ash | Total | Pyritic |
| Pittsburgh Seam | 22.0 | 1.7 | 0.95 | 76.1 | 3.3 | 43 | 70 |
| Kentucky No. 9 | 14.6 | 5.1 | 3.1 | 83.7 | 3.6 | 57 | 90 |

Bridging liquid addition: 1% by coal weight

Results with Kentucky No. 9 coal confirmed that very high, 90% pyrite sulfur rejection can be achieved using the two-stage process shown in FIG. 2. The same coal tested in the process shown in FIG. 1 process rejected about 60% pyritic sulfur.

In conclusion, the process of the invention either in a single or two-stage (with interstage wet grinding) mode leads to very high rejection of pyritic sulfur if the coal product suspended in water is subjected to a series of rapid agitation-aeration-dirty water removal-clean water addition cycles.

It is claimed that:

1. A process for reducing sulfur and ash content of bituminous coal comprising the steps of:
   (a) grinding the bituminous feed coal to particle size of less than or equal to 600 micrometers to form a fine coal;
   (b) mixing said fine coal with water and less than 10% by weight of dry coal of a bridging oil to form a coal-water-oil slurry, said bridging oil consisting essentially of from 100–10% of heavy oil or bitumen and 0–90% of a light oil selected from the group consisting of diesel oil, kerosene and naphtha;
   (c) agitating said slurry to form coal microagglomerates;
   (d) separating said micro-agglomerates from said slurry to obtain recovered coal;
   (e) washing said recovered coal with fresh water through at least one wash cycle, said cycle comprising sequentially agitation, aeration, separation of recovered coal from pyrite-containing water, to form a clean recovered coal characterized by substantially reduced sulfur and ash content as compared to said feed coal.

2. A process according to claim 1 further comprising the step of:
   (f) wet-grinding said recovered coal to form a twice-ground coal;
   (g) mixing said twice-ground coal with less than 10% by weight, based on the weight of dry coal, of said bridging oil to form a second coal-water-oil slurry;
   (h) agitating said second slurry to form a twice-ground coal agglomerate;
   (i) separating said twice-ground coal agglomerates from said second slurry to obtain a twice-ground recovered coal;
   (j) washing said twice-ground recovered coal with water by at least one of said wash cycles to form a twice-ground recovered clean coal characterized by substantially reduced sulfur and ash content as compared to said feed coal.

3. A process according to claim 1 or 2 wherein said bridging oil in said steps (b) and (g) is added in an amount of less than 3%.

4. A process according to claim 3 wherein said bridging oil is added in an amount in the range of 0.5–1.0%.

5. A process according to claim 1 wherein said step (e) comprises a plurality of said wash cycles.

6. A process according to claim 2 wherein said step (j) comprises a plurality of said wash cycles.

7. A process according to claim 5 wherein said step (e) comprises three or more of said wash cycles.

8. A process according to claim 6 wherein said step (j) comprises three or more of said wash cycles.

* * * * *

UNITED STATES PATENT AND TRADEMARK OFFICE

CERTIFICATE OF CORRECTION

PATENT NO. : 4,966,608

DATED : Oct. 30, 1990

INVENTOR(S) : Wanda Pawlak, et al

It is certified that error appears in the above-indentified patent and that said Letters Patent is hereby corrected as shown below:

Column 1, insert before first paragraph --This invention was made with Government support under Contract No. DE-FG22-87PC79865 awarded by the Department of Energy. The Government has certain rights in this invention.--

Signed and Sealed this

Twenty-second Day of March, 1994

Bruce Lehman

*Attest:*

BRUCE LEHMAN

*Attesting Officer*

*Commissioner of Patents and Trademarks*